US009393671B2

(12) United States Patent
Webster et al.

(10) Patent No.: US 9,393,671 B2
(45) Date of Patent: Jul. 19, 2016

(54) PROGRAMMABLE COOLANT NOZZLE SYSTEM FOR GRINDING

(71) Applicants: Cool-Grind Technologies, LLC, Ashford, CT (US); Dimensional Control, Inc., South Windsor, CT (US)

(72) Inventors: John A. Webster, Storrs, CT (US); Stephen R. Gardner, Tolland, CT (US)

(73) Assignees: Dimensional Control, Inc., South Windsor, CT (US); Cool-Grind Technologies, LLC, Ashford, CT (US)

( * ) Notice: Subject to any disclaimer, the term of this patent is extended or adjusted under 35 U.S.C. 154(b) by 206 days.

(21) Appl. No.: 14/205,685

(22) Filed: Mar. 12, 2014

(65) Prior Publication Data

US 2014/0273750 A1 Sep. 18, 2014

Related U.S. Application Data

(60) Provisional application No. 61/782,673, filed on Mar. 14, 2013.

(51) Int. Cl.

| | |
|---|---|
| ***B24B 53/095*** | (2006.01) |
| ***B24B 53/00*** | (2006.01) |
| ***B24B 55/03*** | (2006.01) |
| ***B24B 55/02*** | (2006.01) |

(52) U.S. Cl.

CPC ..... *B24B 53/095* (2013.01); *B24B 53/005* (2013.01); *B24B 55/02* (2013.01); *B24B 55/03* (2013.01)

(58) Field of Classification Search

CPC ..... B23D 59/01; B23Q 11/10; B23Q 11/126; B24B 49/14; B24B 49/18; B24B 53/095; B24B 55/02; B24B 55/03

See application file for complete search history.

(56) References Cited

U.S. PATENT DOCUMENTS

| | | | | |
|---|---|---|---|---|
| 3,543,451 | A * | 12/1970 | Smith | B24B 55/045 451/450 |
| 7,101,256 | B2 * | 9/2006 | Sudo | B24B 7/228 451/450 |
| 7,452,261 | B2 * | 11/2008 | Gretler | B24B 55/02 451/11 |
| 9,242,344 | B2 * | 1/2016 | Graham | B23Q 11/10 |
| 2006/0040584 | A1 * | 2/2006 | Ray | B24B 1/00 451/5 |
| 2010/0130106 | A1 * | 5/2010 | Hyatt | B24B 5/02 451/53 |
| 2011/0081844 | A1 * | 4/2011 | Dremel | B23F 5/04 451/259 |
| 2013/0095734 | A1 * | 4/2013 | Zaruba | B24B 55/03 451/449 |
| 2015/0126097 | A1 * | 5/2015 | Li | B05B 5/03 451/450 |

* cited by examiner

*Primary Examiner* — Timothy V Eley
(74) *Attorney, Agent, or Firm* — Alix, Yale & Ristas, LLP

(57) ABSTRACT

A programmable coolant nozzle system and method for grinding wheel machines. The system comprises a fluid manifold block that automatically or manually follows the wear of the grinding wheel, to position coolant jets tangential to the wheel surface throughout the life of the grinding wheel. The positioning is by an arcuate motion, through a parallelogram mechanism, to ensure that the coolant jets remain at the same angle to the grinding wheel surface throughout the entire range of motion.

18 Claims, 14 Drawing Sheets

PROGRAMMABLE COOLANT NOZZLE SYSTEM FOR GRINDING

RELATED APPLICATION

This application claims the benefit under 35 U.S.C. §119 (e) of U.S. Provisional Application No. 61/782,673 filed Mar. 14, 2013 for "Programmable Coolant Nozzle System for Grinding".

GOVERNMENT CONTRACT

The present invention was made in the course of U.S. Government Agreement No. FA9550-08-1-0312 with the U.S. Air Force Office of Scientific Research.

BACKGROUND

The present invention relates to the cooling of grinding wheels used in grinding processes.

Grinding is a manufacturing process where a rotating grinding wheel, made from hard abrasive grain, is used to machine a metallic or ceramic part into a precise form. To achieve this, the grinding wheel wears in the process and heat is also generated. Liquid coolant, applied by a nozzle, is used to remove the heat from the process and provide lubrication, and must be critically aimed at the grinding region. As the grinding wheel wears, the coolant nozzle aim gradually strays from the ideal position, leading to undesirable dimensional and material structure changes to the component, and a greater wear rate of the grinding wheel. As the grinding wheel wears it also gets dull and a diamond dressing process is typically used to restore the sharpness and roundness of the wheel.

To accommodate these changes to the grinding wheel, the machine operator would typically redirect the coolant nozzle from time to time, which can be subjective, infrequent, and imprecise.

SUMMARY

The present invention addresses these problems associated with adjusting the aim of the nozzle or nozzles as the conditions of the grinding wheel change over time, and is usable in grinding machines and vertical and horizontal spindle machining centers that use grinding wheels.

The present invention allows the machine operator to objectively and precisely adjust the nozzle as the grinding wheel diameter changes. The adjustment can be made manually, remotely under the control of the operator, or automatically.

In one aspect, the disclosure is directed to a machine tool that uses a grinding wheel having a circumferential grinding surface which rotates about a spindle axis with diameter that varies over time, by positioning a cooling fluid manifold block relative to the spindle axis, with at least one fluidly connected nozzle directing a jet of coolant toward the grinding surface along a discharge centerline at any angle relative to vertical, and as the diameter of the grinding wheel varies over time, articulating the manifold block along an arcuate path whereby each of the least one nozzles follows a corresponding arcuate path while maintaining each centerline at the original angle relative to vertical.

Thus, at a first condition of the grinding wheel at a first diameter the at least one nozzle is at a first position with discharge centerline pointing to a clock position on the grinding wheel surface and in a second condition in which the grinding wheel diameter has changed over time, the at least one nozzle moves along the corresponding path to a second position with discharge centerline pointing to the same clock position on the grinding wheel surface.

In another aspect, the disclosure is directed to a coolant system with a fluid pressure manifold block having a fluid inlet and supporting at least one fluidly connected coolant nozzle aimed to deliver cooling fluid onto the grinding surface along the direction of rotation. A parallelogram mechanism is connected to the manifold block, and a drive system is operatively associated with the manifold block to displace the manifold block in an arcuate path defined by the parallelogram mechanism. In this way, the at least one nozzle is displaced along a corresponding arcuate path relative to the grinding surface.

In yet another aspect, the disclosure is directed to a remotely controlled coolant nozzle system. The coolant nozzle system is attached to the grinding wheel spindle housing such that the coolant stream hits the wheel close to the intersection between the wheel and the part where the grinding is taking place. The nozzle system includes at least one nozzle but typically includes a plurality of nozzles aimed across the width of the grinding wheel. The aim of the nozzle jets relative to the grinding wheel is set between +/−20 degrees of being tangential to the wheel surface, depending on the process. The nozzle system is supplied with coolant by a pump located elsewhere on the machine tool.

Actuation of the nozzle system is performed by, but not limited to, an electric motor such as described in U.S. Pat. No. 6,772,042, Aug. 3, 2004, "Programmable Coolant Nozzle System", the disclosure of which is hereby incorporated by reference. Pneumatic, gas and hydraulic motors and cylinders, electrical solenoids, and stored energy devices, can also be used. In automatic control mode the nozzle aim is by an on-board digital processor that communicates with the machine controller. The algorithm for nozzle system control may be a function of the dressing amount during re-sharpening of the wheel. The custom computer board may move the nozzle(s) after every dressing cycle, or after a set number of dressing cycles. For machines that do not have automatic wheel dressing the control can either be set up to predict the wheel wear rate or allow manual control of the nozzle system by the machine operator. For machines where electronic or software communication between the custom computer board and machine controller cannot be established, control of the nozzles will be achieved through external events such as the dresser nozzle turning on, the grinding wheel moving into the dressing position, dresser motor turning on, etc.

The nozzles fitted to the nozzle system should ideally be capable of withstanding up to 200 psi of coolant pressure, and provide a coherent jet of coolant that hits the grinding wheel as a solid stream instead of breaking up due to dispersion and turbulence, as described in U.S. Pat. No. 6,669,118, "Coherent Jet Nozzles for Grinding Applications", the disclosure of which is hereby incorporated by reference. The flow rate of coolant from the nozzle(s) is controlled by the pump pressure and aperture of the nozzle exit.

In the disclosed embodiment the coolant nozzle system includes a rigid mechanical mount attachable to the grinding spindle housing that can orient the coolant nozzle system vertical, horizontal or any other angle. The mount supports a worm and wheel gearbox drive that is not readily back-drivable by the influence of gravity or coolant nozzle jet reaction force. A fluid inlet coupling from the pump of the machine tool is provided, to deliver fluid to a fluid pressure manifold block supporting at least one nozzle, or a plurality of nozzles arranged in a line substantially parallel to the spindle axis.

The coolant nozzles can be round, flat or have a shaped profile, carried on and in fluid communication with the manifold block for directing a jet of coolant at the grinding surface. A parallelogram mechanism supports and articulates the manifold block in an arcuate path to maintain the coolant jet within +/−20 degrees of being tangential to the grinding surface. An actuator receives a control signal from a control system to articulate the manifold block relative to the grinding surface. The control system generates the control signal commensurate with a change in the diameter of the grinding wheel.

DETAILED DESCRIPTION

Figure 1:
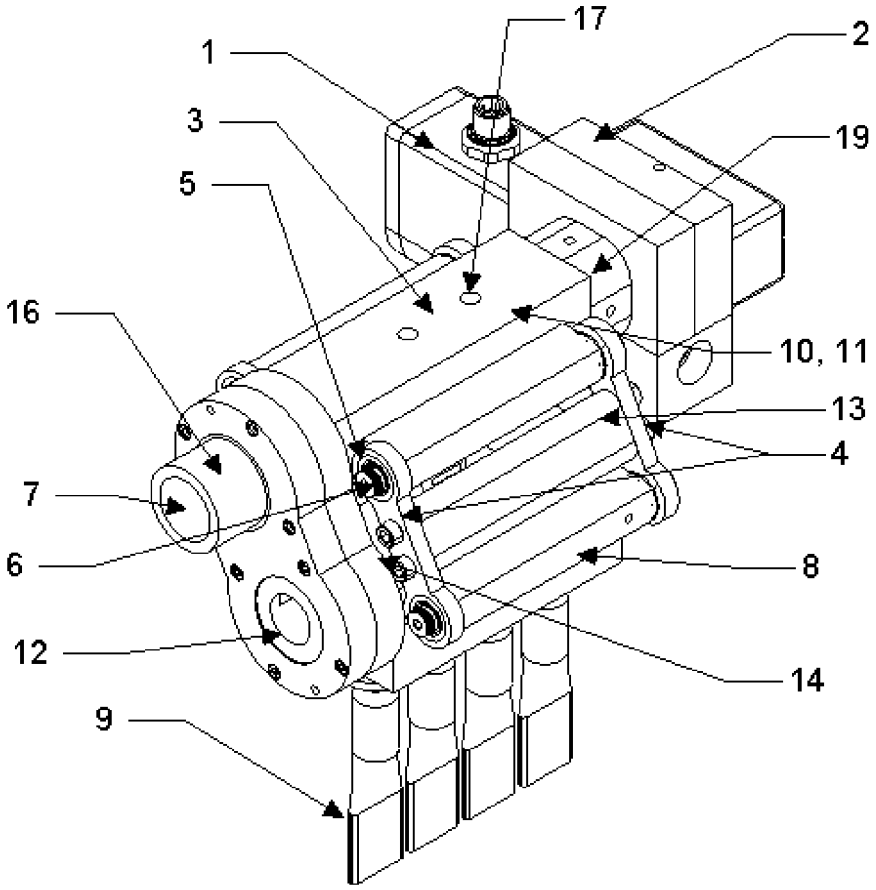
FIG. 1 shows an isometric view of the coolant nozzle system.

With reference to FIGS. 1 to 7, we describe a representative design, individual components and operation of the coolant nozzle system. FIG. 1 shows the full assembly of the coolant nozzle system in isometric view. FIGS. 5*a*-5*d* show views from different angles of the coolant nozzle system situated relative to the surface of grinding wheel 15, which can range from 6 inches to 36 inches diameter and 1 inch to 12 inches wide. FIGS. 1, 2, and 5 show the coolant nozzle system with four nozzles fitted to the manifold 8. In the case where the width of the grinding wheel is less than the maximum width of the combined nozzles, unnecessary nozzles can be removed and their attachment ports in the manifold plugged. Valves can also be used on each nozzle to switch the flow off.

Figure 2A:
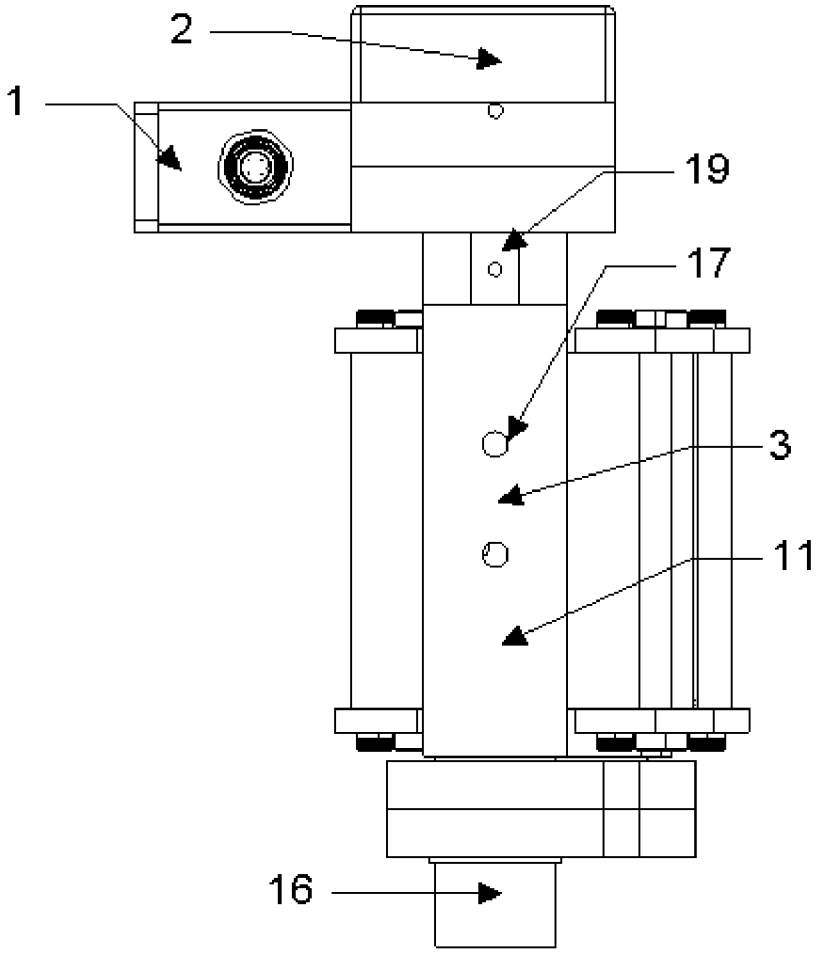
FIGS. 2*a*, 2*b*, and 2*c* show orthographic projections of the coolant nozzle system consisting of front, side and top views.
Figure 2B:
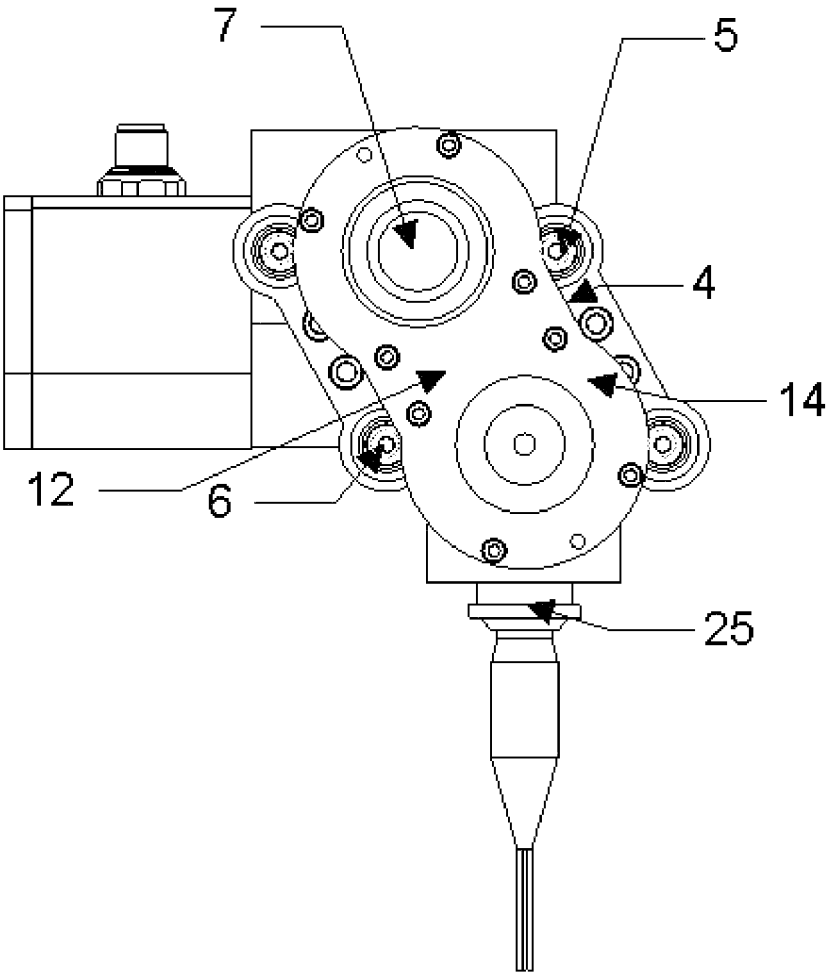
Figure 2C:
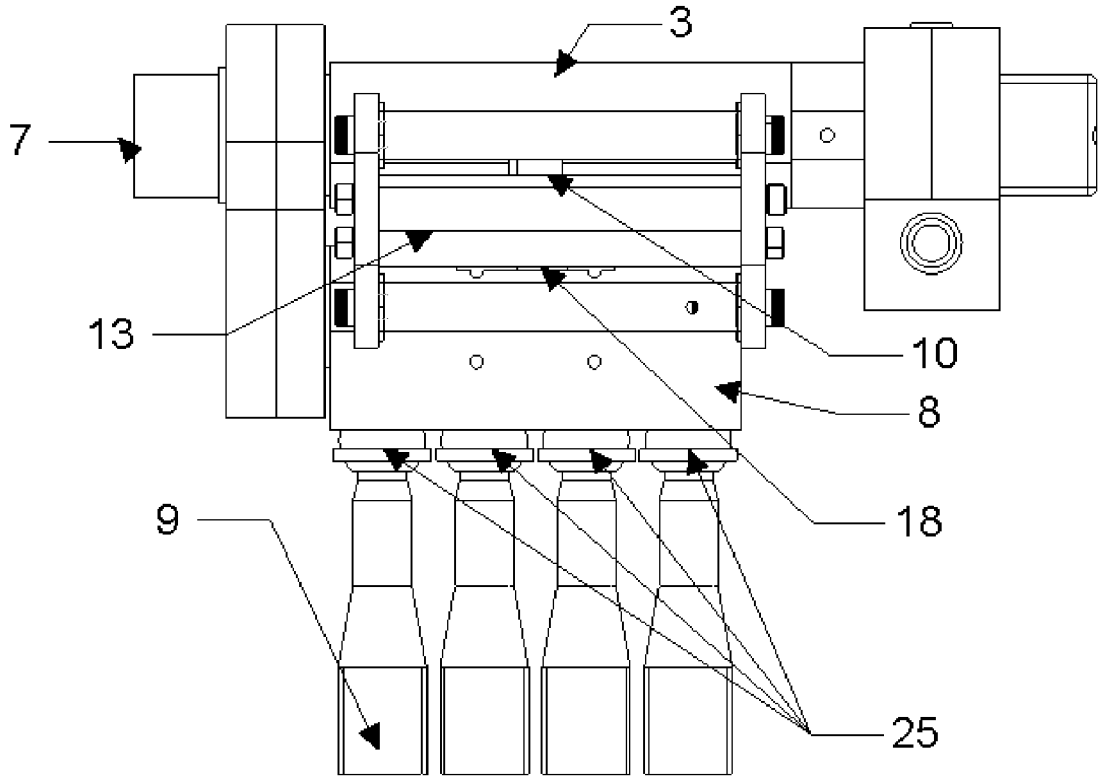
Figure 3A:
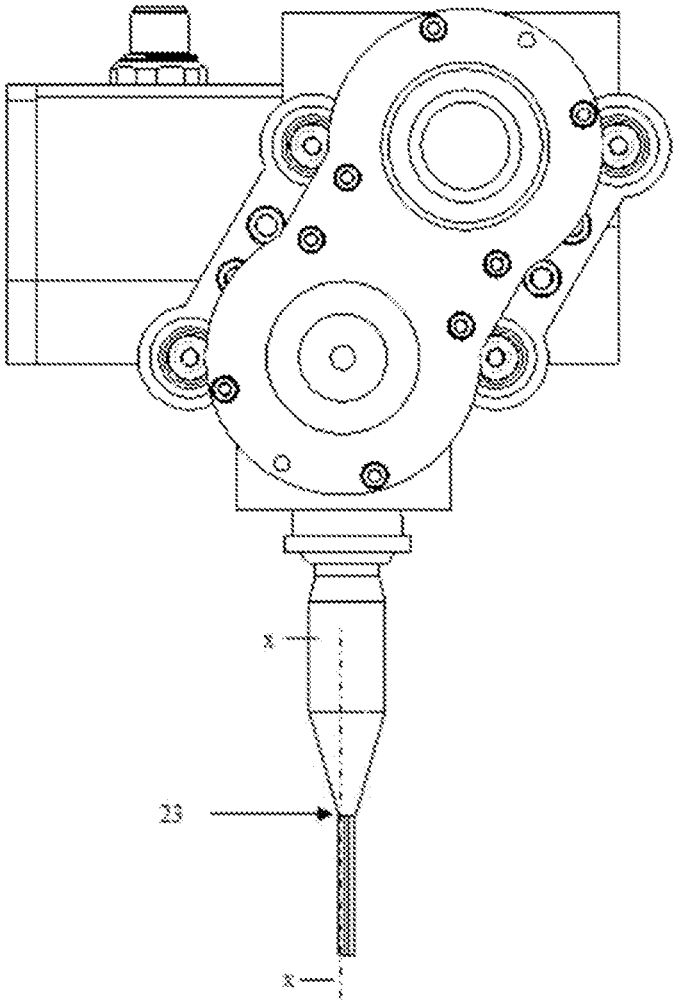
FIGS. 3*a* and 3*b* show the extremes of motion of the coolant nozzle system.
Figure 3B:
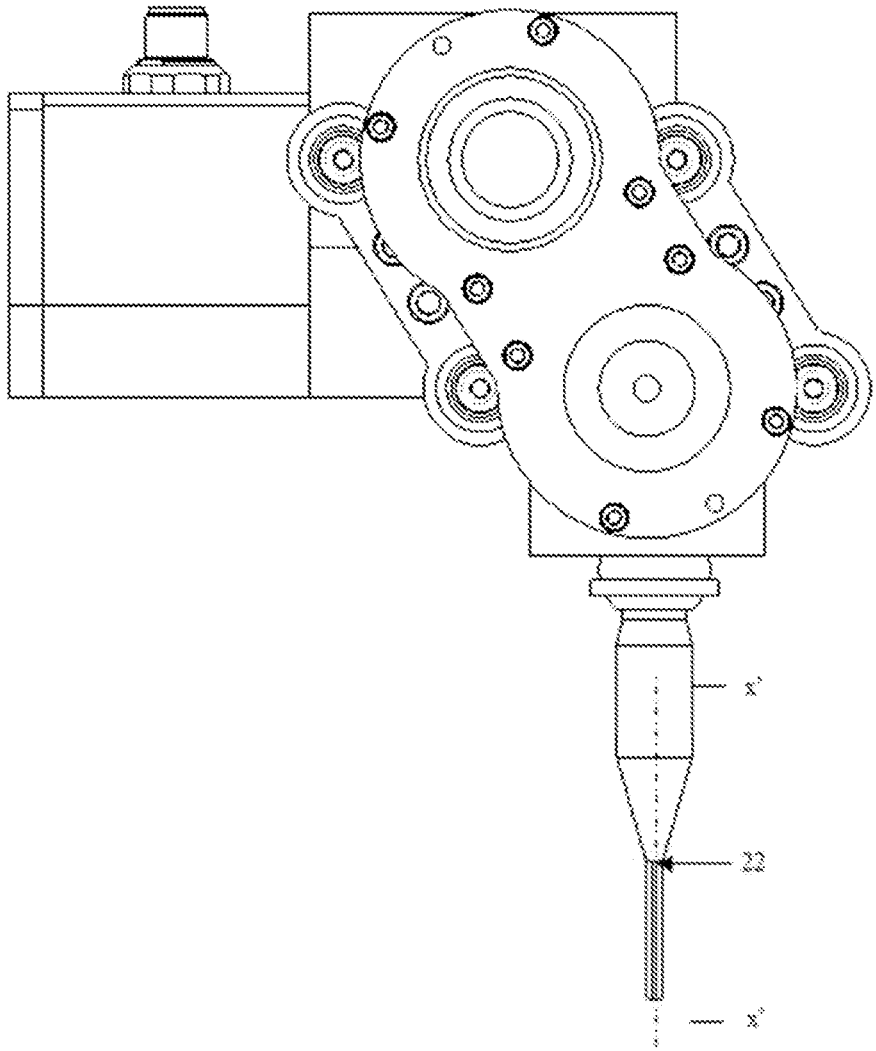
Figure 4:
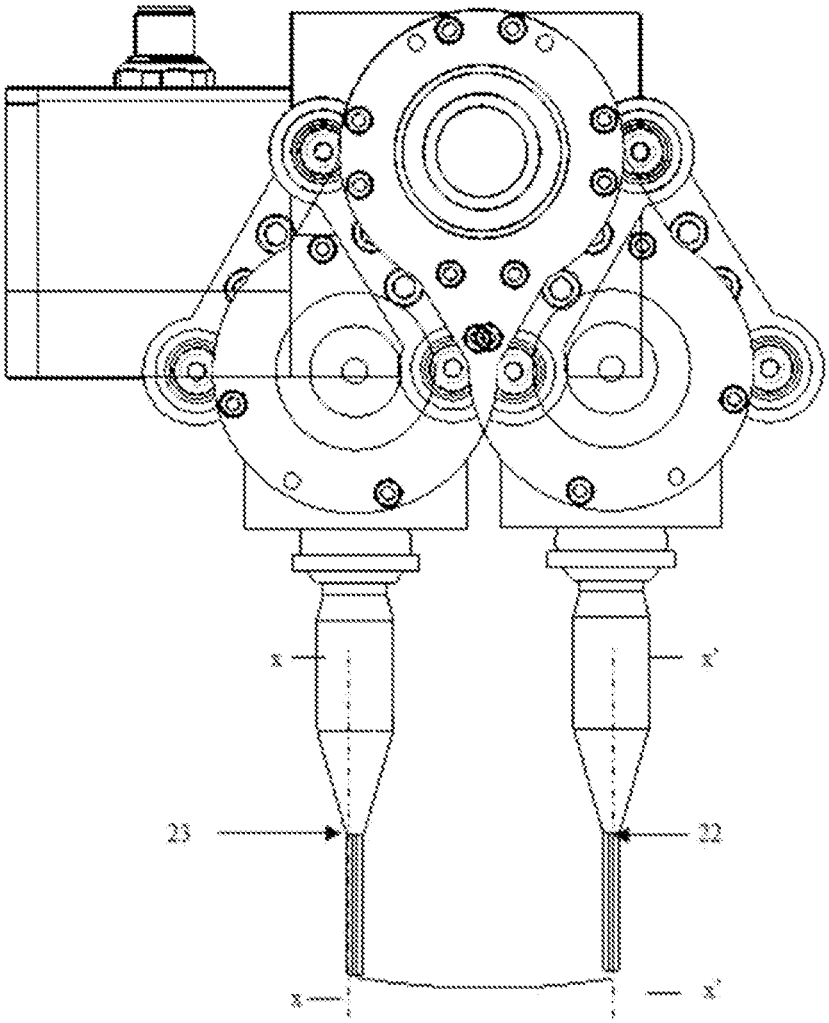
FIG. 4 superimposes the two extremes of motion of the coolant nozzle system, showing the arcuate locus of the nozzle tips.
Figure 5A:
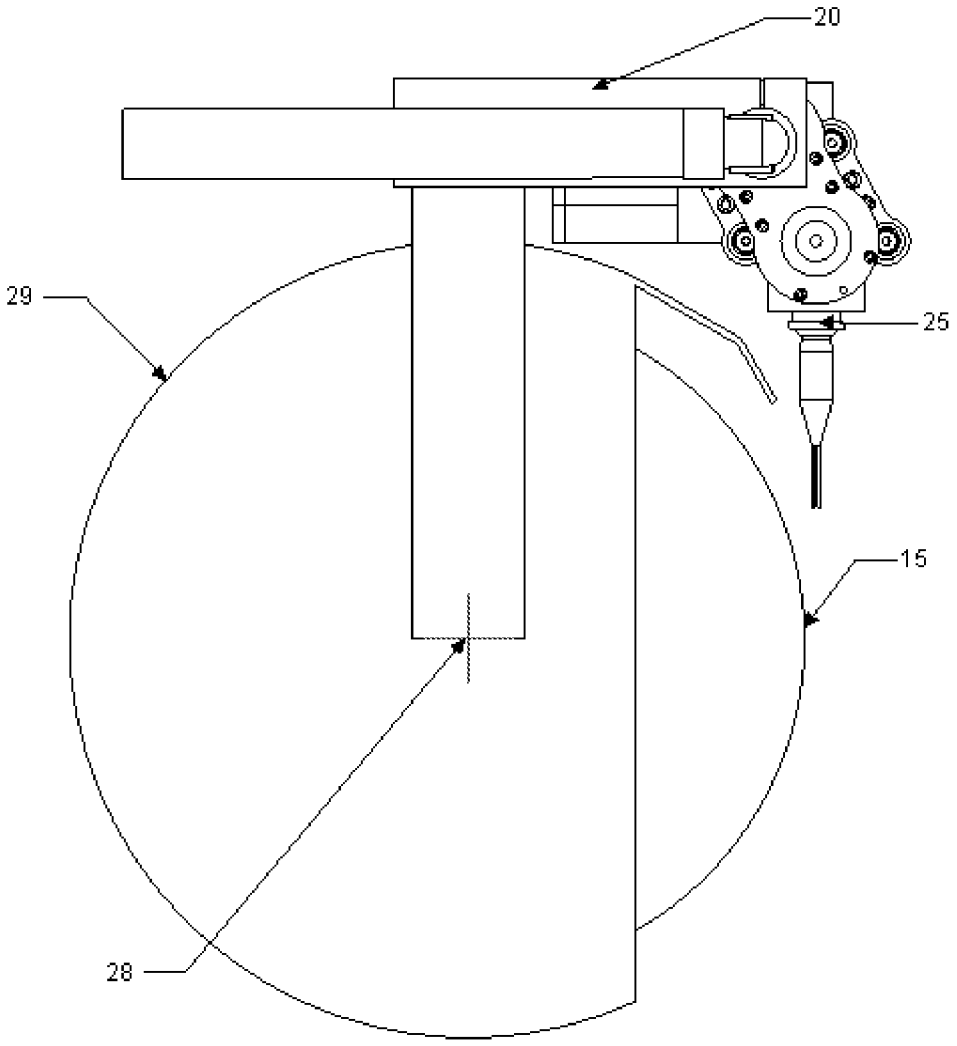
FIGS. 5*a*, 5*b*, 5*c*, and 5*d* show the coolant nozzle system in relation to a grinding wheel.
Figure 5B:
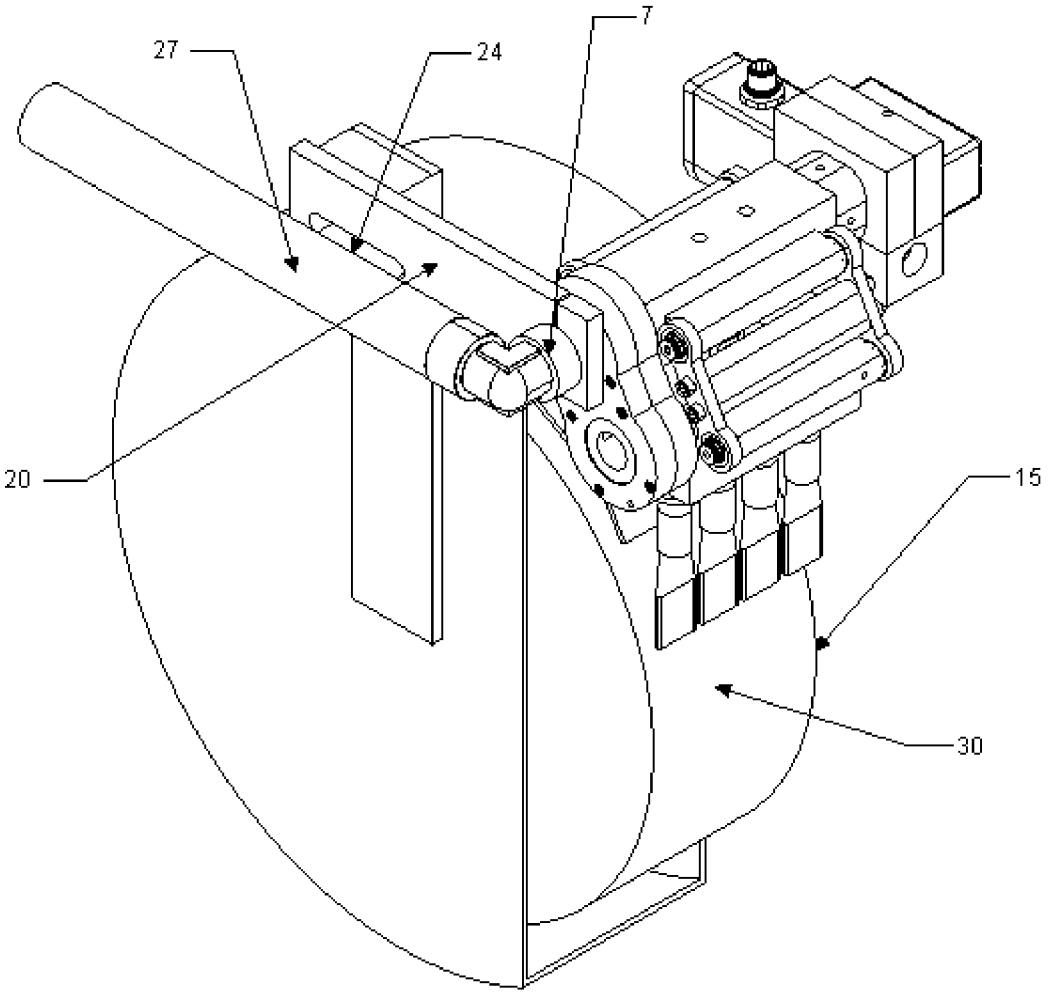
Figure 5C:
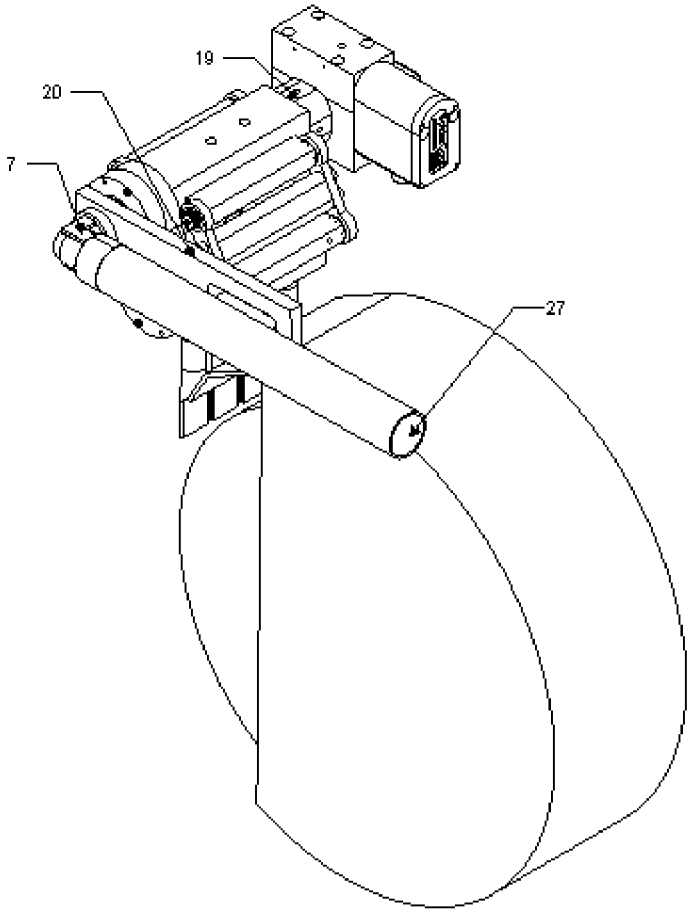
Figure 5D:
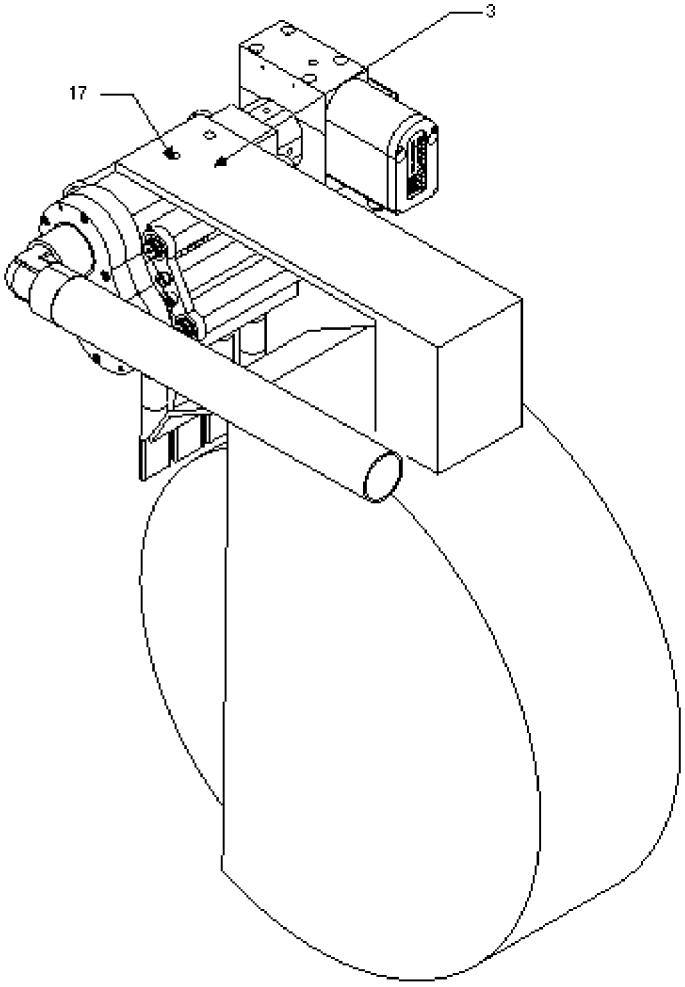

As the grinding wheel reduces in diameter due to use, the controller will move the nozzle(s) 9 towards the left direction in the view of FIG. 5*a* to keep the coolant jet tangentially aligned with the wheel surface. The unit is hydraulically connected to the grinding machine tool by a hose 27 or rigid pipe, by attaching to the inlet port 7 from a pressurized source. The coolant nozzle system is mechanically supported by a macro-adjuster bracket 20 attached to the top mount 3 using the circular mounting boss 16, or an alternative method using the mounting threads 17. A cable is connected to an electromechanical actuator (EMA) 1, such as an electric servomotor, to enable control of the device. FIGS. 2*a*, 2*b*, and 2*c* show the components of the coolant nozzle system in orthographic view. FIG. 3 shows the extremes of motion from new wheel position to fully worn wheel position. The parallelogram mechanism, using two pairs of arms 4 at each end of the device, is clearly shown. As used herein, numeric ID 4 and "parallelogram mechanism" refer to the pivotable arms and associated pivot support for the arms, which can be provided in variety of ways. Throughout the entire range of motion, which can be between 1 to 6 inches (depending on the version), in a predominantly radial direction to the grinding wheel center, the nozzle(s) 9 will always aim in the same tangential direction relative to the surface of the wheel. The jet 22 of coolant is discharged from the tip 23 along center line x, x' and the tip of the nozzle(s) move in an arcuate locus path due to the parallelogram mechanism. FIG. 4 superimposes the two extremes of nozzle position (FIGS. 3*a* and 3*b*) on top of each other clearly showing the arcuate locus. The slot 24 in the macro-adjuster bracket 20 allows the coolant nozzle system to be repositioned if the linear range of the parallelogram system is less than the radius change of the grinding wheel from new to fully worn out.

Figure 6A:
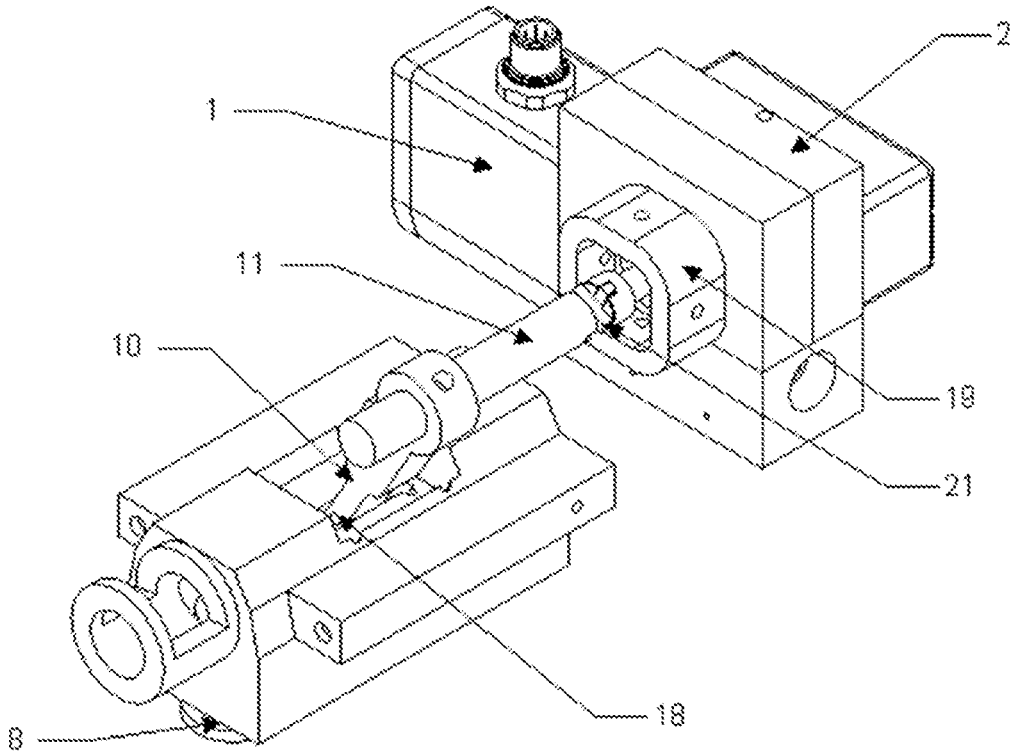
FIGS. 6*a* and 6*b* show the actuator arm, drive shaft, and gearbox drive that translates the manifold.
Figure 6B:
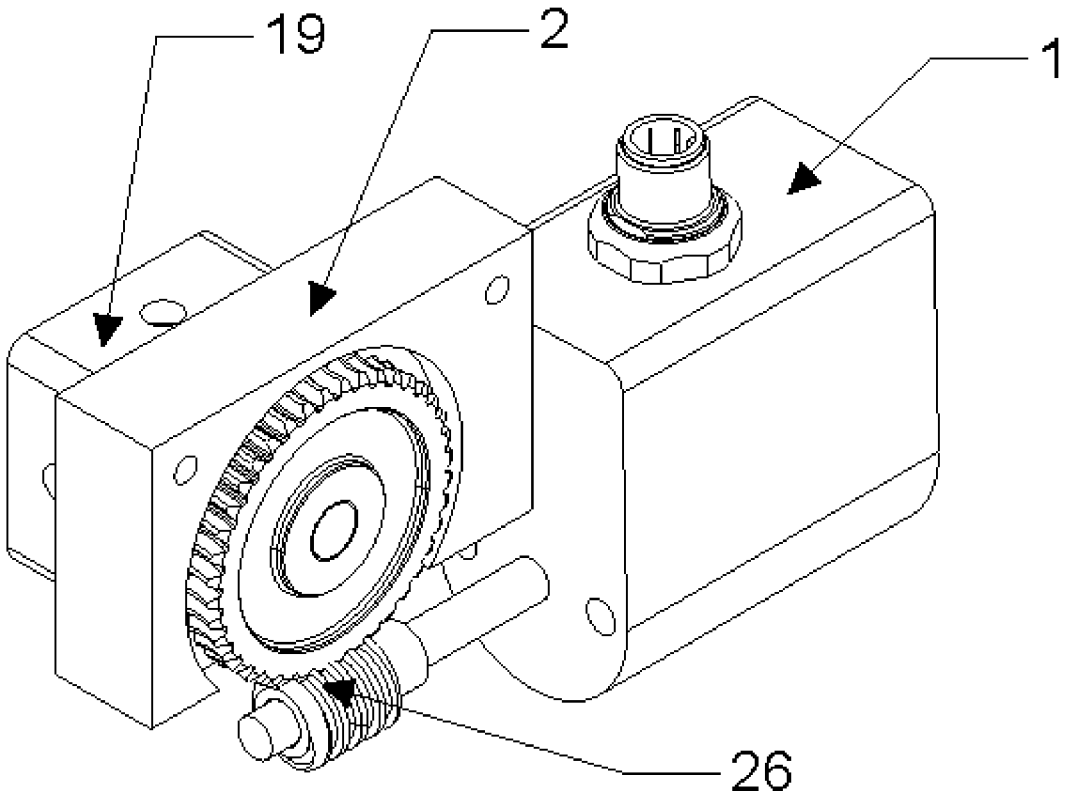

To increase the torque produced by the EMA 1 (also Item 104 in FIG. 7) a rigidly attached worm and wheel gearbox (WWG) 2 (also Item 105 in FIG. 7) is driven by the output of the EMA. FIG. 6*b* shows the details of the worm and wheel arrangement 26, which is a positive drive, and not readily back-driven by the output of the EMA, by gravity or the coolant nozzle jet reaction force and therefore highly suitable for this application. The EMA and WWG are rigidly attached to the top mount 3 through a square spline 19 that is coaxial with the WWG output shaft 11. The square spline allows the EMA and WWG assembly to have the option of four different perpendicular angular positions on the top mount to accommodate possible interference issues on the grinding machine tool. FIG. 6*a* shows that inside the top mount runs a drive shaft 11 driven by the WWG through a self-aligning torsion coupling 21 that leads to an actuator arm 10 which engages into a slot 18 that is on top of the manifold 8. Therefore, the torque from the gearbox gives rise to a near linear translation of the manifold 8. The parallel arms 4 that connect the top mount 3 to the manifold 8, through pivots 6 and bushings 5, convert the linear translation from the actuator arm 10 into an arcuate motion at the nozzle(s) tip. A stiffening brace 13 is fitted between opposing parallel arms with screws 14 to increase axial and yaw stiffness of the parallelogram nozzle mechanism and enable the precise aim of the coolant jets to be maintained regardless of gravitation effects and coolant jet reaction forces.

To couple the coolant flow from the top mount 3 to the manifold 8, a coolant coupling 12 is used. The coolant coupling is hollow, parallel to the parallel arms 4, and contains seals and bushings to minimize leakage and friction. The pivots for the coolant coupling are incorporated into the top mount 3 and manifold 8 and use circumferential transfer ports in each pivot to direct the flow through the coolant coupling. By having a pivot center-to-center distance exactly the same as the four parallel arms 4 the arcuate motion of the manifold is maintained. The reason for the coolant coupling 12 is to eliminate the need for an external hose of unknown stiffness being fitted between the manifold 8 and the grinding machine tool by the user, which needs to be overcome by the EMA torque. Since the inlet port in the top mount is rigidly mounted to the grinding machine tool (GMT), the hose that connects the pump to the nozzle system is de-coupled and cannot influence the motion of the nozzle(s).

Figure 7:
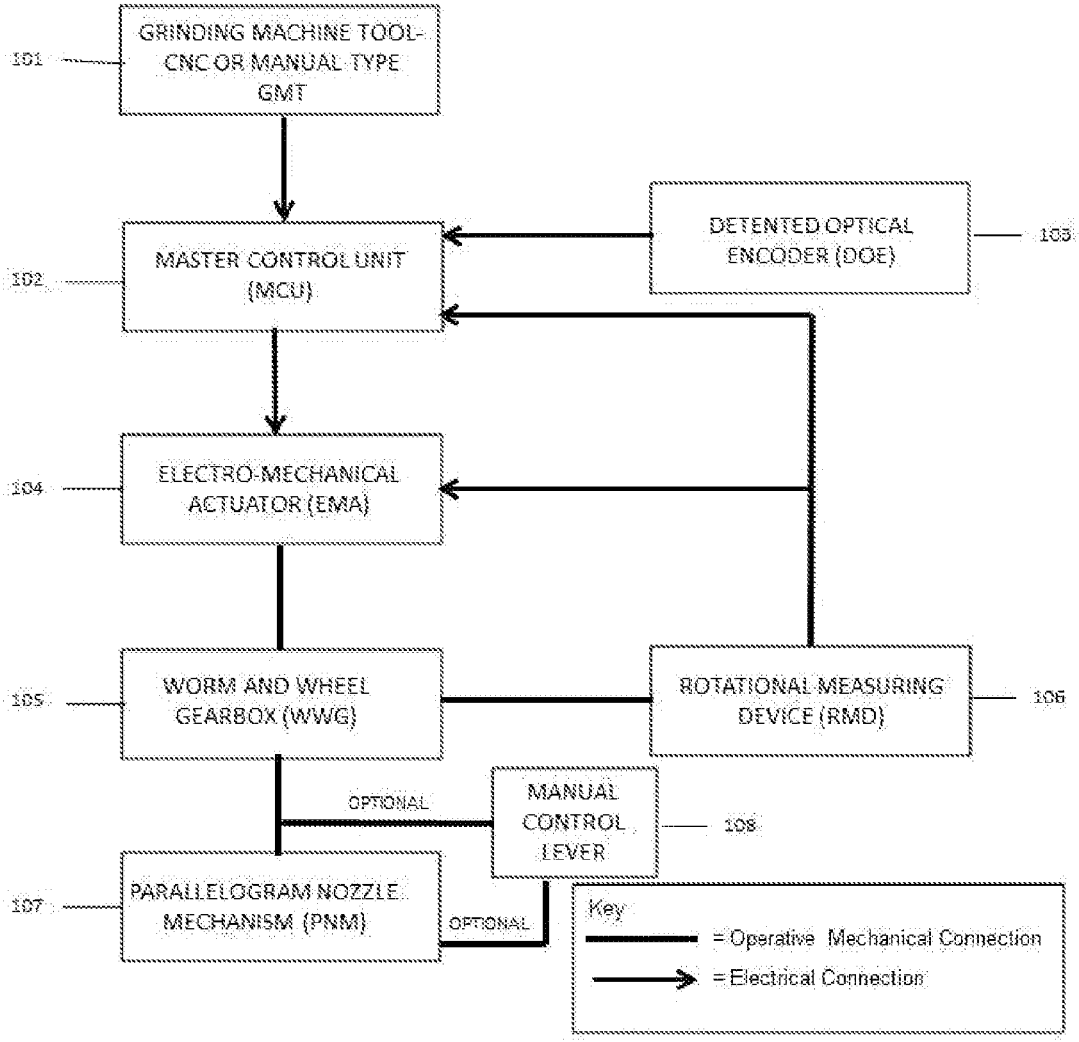
FIG. 7 shows the control system of the coolant nozzle system and connection to the machine tool controller.

FIG. 7 shows the connectivity of the various components of the control system coupled with the nozzle system. The use of a master control unit (MCU) 102, electromechanical actuator (EMA) 104, and detented optical encoder (DOE) 103, are substantially derived from those described in U.S. Pat. No. 6,772,042 B1 FIGS. 3, 4 and 5, Paragraph 2 lines 30-43, Paragraph 3 lines 25-68, Paragraph 4 lines 1-68, Paragraph 5 lines 1-55 and U.S. Pub. 2012/0308323 Paragraph [0006] and Paragraphs [0036-0052], which documents are hereby incorporated by reference. These components are used as a means to automate the positioning of the preferred embodiment described herein. Although DOE 103 is described herein as the technique for inputting data to the MCU 102, this can also be accomplished by switches, pushbuttons, or touch screen.

The MCU 102 is employed to perform the functions of (a) controlling the EMA 104, (b) interfacing with the GMT 101, (c) providing an operator interface to position the nozzles and also to make various MCU programs and settings via use of the DOE 103.

A potentiometer, optical encoder, or other rotational measurement device (RMD) 106 is operatively connected to the centerline axis of rotation of the worm wheel inside the worm wheel gearbox (WWG) 105, and electrically connected to EMA 104 and can be optionally electrically connected in parallel to MCU 102. RMD 106 is used to accurately measure the absolute rotational position of the center axle, or shaft, of the worm wheel. Since this shaft is operatively coupled with the driveshaft 11 with no further gear reduction, the degree of rotation of the worm wheel is exactly equal to the degree of rotation of the driveshaft, less any insignificant mechanical slop, backlash or lost motion which can otherwise be electrically compensated for by MCU 102. Parallelogram nozzle mechanism (PNM) 107 is defined as the entire nozzle mechanism beyond the WWG output shaft and includes the self-aligning torsion coupling 21, driveshaft 11, actuator arm 10, parallel arms 4, manifold 8, nozzles 9, and coolant coupling 12.

Upon receipt of real time output (RTO) data, or other discreet electrical input to MCU 102 from GMT 101, MCU 102 through software algorithms, and the like, will determine a desired target location to which the nozzles of the preferred embodiment PNM 107 shall be moved. MCU 102 will then generate a command to position EMA 104 which will electrically monitor RMD 106 for confirmation of positioning. Upon receipt of a command from MCU 102, EMA 104 will rotate at rate of speed commensurate with the command. Rotational force of EMA 104 is transferred through a self-aligning torsion coupling 21 operatively connected to the worm screw of WWG 105. Engagement of threads on the worm screw with teeth on the worm wheel causes the worm wheel to rotate at a rate proportionate to, and slower than, the worm screw, also increasing the torque available for moving the nozzles. Therefore the RMD is more effective if it is driven by the wheel not the screw and makes less than one revolution, as compared to the many revolutions of the worm screw.

As the worm wheel rotates RMD 106 generates electrical signals which are transmitted to EMA 104, and optionally MCU 102. As a desired reading of RMD 106 is reached, EMA 104 ceases to rotate and instead maintains an energized but non-rotating state in order to hold position. Alternatively prior to reaching a non-rotating command state, through software timing algorithms and/or monitoring RMD 106 signal, MCU 102 and/or EMA 104 circuitry can; (a) cause EMA 104 to decelerate as a target position is reached, and/or (b) cause EMA 104 to position beyond the target point then position in the opposite direction until the target point is reached. These alternate positioning techniques reduce unnecessary wear by minimizing abrupt motion, and improve positioning accuracy by approaching target points in a unidirectional manner which minimizes positioning errors caused by backlash or lost motion. Lost motion can be defined as any movement of the nozzles that is not commanded by MCU 102 and is often caused by slop in mechanical linkages or couplings. The closed-loop nature of the positioning system is such that unintended forces which would cause the worm wheel to rotate will also cause RMD 106 to generate a signal indicating the worm wheel has strayed from the commanded or intended position. MCU 102 and/or EMA 104 will receive and act upon the RMD 106 signal by generating rotational movement such that a positioning correction occurs. Additionally, if a desired reading of RMD 106 is unable to be achieved within a specified time, MCU 102 can generate an electrical output to GMT 101 indicating an error condition has occurred which could lead to incorrect positioning of the PNM. Upon receipt of this output, the GMT can be set to alert the operator and/or cease further operation of the grinding process until the problem is addressed. Similarly, use of an output from MCU 102 to GMT 101 can be employed to indicate that a desired RMD 106 reading has been achieved. Upon receipt of this output the GMT can be set to proceed with the grinding process The near-linear travel of the manifold 8 and corresponding nozzles 9 equates radially with the grinding wheel and perpendicular to the grinding wheel centerline of rotation. This linear travel is ideally controlled to a resolution of at least 1 mm. The degree of driveshaft rotation required to achieve a corresponding linear distance of nozzle movement is a mathematical function of the arcuate motion path (locus) of the manifold upon which the nozzles are fastened, and the distance between the centerlines of the pivot points on the parallel arms of the parallelogram device. The necessary mathematical computations are performed by MCU 102 and processed such that commensurate commands are transmitted to EMA 104 to enable the system to maintain the desired linear resolution throughout the travel range.

Many GMTs incorporate use of a computer numerical control (CNC) system and are considered to be CNC. Those that do not are considered manual machine tools. The primary purpose of the interface between MCU 102 and grinding machine tool 101 is in essence to establish that a wheel dressing, or series of wheel dressings has occurred and that action must be taken to reposition the nozzles to compensate for the reduction in wheel diameter.

In the case of a manual GMT, a proximity sensor, limit switch or other sensor can be electrically connected to an MCU 102 input and employed such that it is actuated each time a wheel dressing cycle occurs on GMT 101. MCU 102 through use of DOE 103 can be programmed to; (a) monitor any number of dressing cycles before commanding EMA 104 to position, (b) store a desired distance to position the nozzles through control of EMA 104 when a set number of dressing cycles has occurred.

While the same methods can also be employed on a CNC machine tool, the CNC enables a more robust variety of interface options and hence capabilities.

M-codes are commonly used by CNC machines to control external devices. M-codes are embedded in a CNC program, and when executed cause an electrical voltage, pulse or contact closure to either occur or stop occurring. Such electrical signals can be connected to an MCU 102 input to indicate a number of dressing cycles has occurred. Multiple discrete M-code outputs from grinding machine tool 101 can be connected to multiple discrete MCU 102 inputs so that different actions can be taken by MCU 102 based upon the electrical state of the inputs. One example would be positioning the nozzles to a specific absolute location within the travel range rather than only an increment of the resolution, or other specific distance.

Additionally, through use of real time output (RTO) as described in U.S. Pub. 2012/0308323 Paragraphs 0050-0052, information can be communicated from the CNC GMT 101 to MCU 102 in order to directly control motion, or implement other functions such as those described in the aforementioned application. Within CNC grinding machine tool 101, macros or other programs as well as user and system variables can be employed to track the amount of wheel material removed per dressing cycle, number of dressing cycles, and the like. The CNC GMT 101 macro can perform any desired mathematical computations, Boolean logic, and the like to generate and format data to be transmitted to MCU 102 for further action. Such actions include positioning of the nozzles, but may also include program information and parameter settings such as to vary the resolution or other behavior of the system. The different nozzle system control modes are as follows:

In manual electric mode, positioning of the nozzles can be accomplished by use of DOE 103. DOE 103 incorporates both pushbutton on/off and A/B quadrature output based on rotation. Mechanical detents facilitate a calibrated increment of DOE 103 rotation. After power-up, or otherwise having been placed in automatic mode, actuating DOE 103 push button will cause an input to MCU 102 which places the unit in manual electrical positioning mode. In this mode, rotating DOE 103 will cause electrical inputs to MCU 102, which will cause MCU 102 to respond by generating output to EMA 104 causing it to rotate. Each detent in DOE 103 rotation can be calibrated through software in MCU 102 to correspond with any specific amount of EMA 104 rotation, which can further be set to correspond with any desired linear positioning resolution of the nozzle within the capabilities of the PNM system.

The system is placed in automatic mode upon power up. If the system is in manual electrical mode actuating DOE 103 pushbutton places the system in automatic mode. In automatic mode, MCU 102 does not respond to rotation of DOE 103 and instead awaits electrical input from the CNC or manual grinding machine tool 101. When electrical input is received, MCU 102 acts in response to it.

In real time mode, when an RTO type of interface is employed, the system can still be placed in manual electrical or automatic modes as described. However, whenever an RTO command is received by MCU 102 it will be acted upon immediately and may also place the system in automatic mode as selectable by software.

From the foregoing description of components, function, and control, it should be understood that the coolant system can be mounted relative to the spindle axis 28, with the nozzle centerlines nominally aimed for contact at any clock position on the grinding surface 30, at any angle of impingement, e.g., measured relative to vertical. For example, the nominal aiming can be tangential at the 2:00 o'clock position or radial at the 3:00 o'clock position. The nozzles can be automatically re-aimed continually as needed, along the arcuate path, to maintain the same angle of impingement at the same clock position as the wheel diameter changes. As used herein, "continually" encompasses continuous, periodic, occasional, or on any schedule that may be pre-established or set by an algorithm associated with controller.

It should also be understood that the actuator for moving the manifold block can act directly on the manifold block, or alternatively with a straightforward modification, directly on the parallelogram mechanism, without changing the fundamental feature that the manifold block is displaceable on an arcuate path, preferably over an included angle of at least +/−20 deg. The nozzles are desirably mounted on the manifold block with swivel capability so that during set-up the nominal aiming points of multiple nozzles can be in parallel or selectively offset from parallel. As the wheel decreases in diameter, the nominal aiming angle of the coolant jets does not change, but the clock position and angle of impingement deviate from nominal. Upon reaching a measured or inferred maximum acceptable deviation, the impingement angle and contact clock position can be restored with a controlled movement of the manifold block along the arcuate path. The aim (impingement angle and clock position) is toward and generally referenced to the grinding surface, but in use the effect of the aim can be for the coolant jet to first strike the grinding surface, work piece, or interface.

The disclosed embodiment is highly accurate for converting a control signal into the desired arcuate movement of the nozzles due in large part to the rigid connection of the mounting fixture to the spindle housing (or other structure in fixed relation to the spindle axis), the rigid connection of the gearbox relative to the mounting fixture, a positive action (no slip) gear train, the rigid connection of the manifold block and the posts for the parallelogram to any member (such as the gearbox or intermediate member to the mounting fixture) that is fixed with respect to the spindle axis, and the direct mechanical drive among the gears, actuator, and manifold block. In the disclosed embodiment, the only connections between the top mount and the manifold block are the pivotable arms and the actuator arm. The rigid connections could also be achieved with the motor and gearbox integrated with (e.g., mounted in) the manifold block.

The worm wheel gearing holds position even if the power is cut to the motor. The rotational measuring device only holds position when the power is applied or maintained. If a worm wheel gear is not employed but instead a servo with power continuously applied is used, the drive can still be considered non back-driveable. Moreover, a stepping type electric motor could also be employed. This contribution to accuracy can be implemented with any of these or equivalent positive drive techniques.

The invention claimed is:

1. A coolant nozzle system for a machine tool that uses a grinding wheel having a diameter and a corresponding circumferential grinding surface when rotated around the axis of a spindle that passes through a spindle housing, comprising:

a rigid mechanical mount;

a drive carried by the mount;

a fluid pressure manifold block;

an inlet port fluidly connectable to a source of cooling fluid for providing a flow of cooling fluid to the manifold block;

at least one nozzle carried on and in fluid communication with the manifold block for directing a jet of coolant toward the grinding surface;

a parallelogram mechanism connected to the manifold block for supporting and articulating the manifold block in an arcuate path; and a drive system including an actuator operatively connecting the manifold block with the parallelogram mechanism and thereby articulating the manifold block on said arcuate path relative to the grinding surface.

2. The coolant nozzle system according to claim 1, wherein the actuator is responsive to a control signal from a control system to articulate the manifold block relative to the grinding surface; and the control system generates said control signal commensurate with a change in the diameter of the grinding wheel.

3. The coolant nozzle system according to claim 2, wherein a nozzle control system includes a control logic dependent on determining the position of the manifold block from measuring a movement characteristic of the actuator and the nozzle control system generates the control signal to articulate the manifold block relative to the circumferential grinding surface so as to maintain the coolant jet within +/−20 degrees of being tangential to the grinding surface.

4. The coolant nozzle system according to claim 3, wherein the grinding wheel spindle is under the control of a machine tool control center and the control logic for the nozzle control system is dependent on grinding wheel dressing data stored in the machine tool control center.

5. The coolant nozzle system according to claim 3, wherein the grinding wheel spindle is under the control of a machine tool control system and the nozzle control system includes automated control logic that is dependent on an electrical signal or contact closure asserted independently of logic within the machine tool control system and upon occurrence of a grinding wheel dressing cycle.

6. The coolant nozzle system according to claim 1, including a manual control mode for manually positioning the at least one nozzle for directing a jet of coolant, in relationship to the diameter of the grinding wheel.

7. The coolant nozzle system according to claim 1, wherein each nozzle is connected to the manifold with a swivel.

8. The coolant nozzle system according to claim 1, wherein the rigid mount includes a bracket extending longitudinally in a first direction;

the fluid pressure manifold block extends longitudinally in a second direction perpendicular to the first direction and supports a plurality of nozzles fluidly connected to the manifold block in parallel and extending longitudinally in a third direction perpendicular to said first and second directions;

whereby the manifold block and nozzles follow an arcuate path in a direction parallel to said first direction;

the actuator receives a control signal from a nozzle control system to articulate the manifold block relative to the grinding surface; and the control system generates said control signal commensurate with a change in the diameter of the grinding wheel.

9. The coolant nozzle system according to claim 8, wherein the bracket is attachable to the housing and adjustable to reposition the coolant system relative to the housing to establish a selectable reference condition for the control logic.

10. The coolant nozzle system according to claim 8, wherein the manifold block has an inlet port and the coolant system includes a stationary fitting associated with said bracket for clamping a coolant hose from a source of coolant, and a closed flow path is provided between the stationary fitting and the manifold block inlet port.

11. The coolant nozzle system according to claim 10, wherein the manifold block inlet port is spaced in said third direction from and extends in said second direction parallel with said fitting, and a pivotable fluid coupling leads from the fitting to the port, for arcuate movement with the parallelogram mechanism, to transfer coolant from the inlet port to the manifold block.

12. The coolant nozzle system according to claim 8, wherein the actuator includes a positive drive and associated rotatable shaft that extends in said second direction with a transverse actuating arm that engages and displaces the manifold along said arcuate path.

13. The coolant nozzle system according to claim 8, wherein the grinding wheel spindle is under the control of a machine tool control center and the nozzle control system includes control logic that communicates with the machine tool control center to determine how far to articulate the manifold based on wheel wear or dressing frequency as derived from the machine tool control center.

14. The coolant nozzle system according to claim 8, including manual override control that allows the machine operator to position the coolant nozzles initially before the control system takes control of the nozzle system.

15. The coolant nozzle system according to claim 8, wherein the drive system includes an electric motor, a gearbox, and a drive shaft in fixed relation to the rigid mount and rotatable about a drive shaft axis, whereby the gearbox rotates the drive shaft which rotates an actuator arm about the drive shaft axis, and said arm moves the manifold block and parallelogram mechanism.

16. The coolant nozzle system according to claim 15, wherein the drive system includes a worm and wheel gearbox.

17. In a coolant nozzle system on a machine tool that uses a grinding wheel having a circumferential grinding surface when rotated coaxially around the axis of a spindle, the improvement comprising:

a fluid pressure manifold block having a fluid inlet and supporting at least one fluidly connected coolant nozzle aimed to deliver cooling fluid onto the grinding surface;

a parallelogram mechanism connected to the manifold block; and a drive system operatively associated with the manifold block to displace the manifold block in an arcuate path defined by the parallelogram mechanism, whereby the at least one nozzle is displaced along a corresponding arcuate path.

18. The coolant nozzle system according to claim 17, wherein a mount is in fixed position relative to the grinding wheel axis;

the drive system is supported by the mount and includes an actuator operatively connected to the manifold block;

a plurality of nozzles are fluidly connected to the manifold block and aligned in parallel with the spindle axis, each nozzle pointed along a respective discharge centerline angle relative to vertical;

wherein displacement of the nozzles along said corresponding arcuate path maintains each centerline at said angle relative to vertical.

* * * * *